US005861612A

United States Patent [19]

Brodsky et al.

[11] Patent Number: 5,861,612

[45] Date of Patent: Jan. 19, 1999

[54] MULTIMODE ELECTROMAGNETIC WAVE ENERGY REJECTION FILTER ARRANGEMENT FOR A SLOT WAVEGUIDE

[75] Inventors: Yuri Brodsky; Kovalev Nikolai, both of N. Novgorod, Russian Federation; Eung Su Kim; Kyu Wan Cho, both of Kyungki-Do, Rep. of Korea

[73] Assignee: LG Electronics, Inc., Rep. of Korea

[21] Appl. No.: 843,780

[22] Filed: Apr. 21, 1997

[30] Foreign Application Priority Data

Apr. 24, 1996 [RU] Russian Federation ..... 96108153

[51] Int. Cl.[6] ..... H05B 6/76

[52] U.S. Cl. ..... 219/738; 219/739; 219/741; 333/212; 174/35 R

[58] Field of Search ..... 219/738, 740, 219/741, 742, 743; 333/212, 211, 208; 174/35 R, 35 GC

[56] References Cited

U.S. PATENT DOCUMENTS

| | | | |
|---|---|---|---|
| 3,651,300 | 3/1972 | Haagensen | 219/741 |
| 3,891,818 | 6/1975 | Valtersson | 219/738 |
| 4,584,447 | 4/1986 | Kusunoki et al. | 219/742 |
| 4,700,034 | 10/1987 | Lee | 219/742 |
| 4,868,359 | 9/1989 | Iwabuchi et al. | 219/742 |
| 5,036,171 | 7/1991 | Kim et al. | 219/742 |
| 5,075,525 | 12/1991 | Jung | 219/742 |
| 5,448,210 | 9/1995 | Marcoux . | |
| 5,495,217 | 2/1996 | Garcia . | |

FOREIGN PATENT DOCUMENTS

| | | | |
|---|---|---|---|
| 196214 | 10/1986 | European Pat. Off. . | |
| 2583234 | 6/1985 | France . | |
| 54-97846 | 8/1979 | Japan | 219/742 |

OTHER PUBLICATIONS

S. Ohkawa, et al., "High Performance Door Seal For Microwave Oven", *Microwave Power Symposium Digest,* 1978.

Koji Iwabuchi et al., Effect of Conductor Losses in New–Structure Filters for Suppressing Microwave Leakage, *Electronics & Communications In Japan, Part II—Electronics,* vol. 75, No. 9, 1 Sep. 1992 pp. 80–89, XP000354569.

*Primary Examiner*—Philip H. Leung
*Attorney, Agent, or Firm*—Ostrolenk, Faber, Gerb & Soffen, LLP

[57] ABSTRACT

A multimode electromagnetic wave energy rejection filter arrangement for a slot waveguide includes at least one system of series coupled LC-circuits located, at least partly, within a cavity of the slot waveguide and arranged along a predetermined line intersecting the wave vectors of electromagnetic waves to be rejected, the LC-circuits including lumped elements and the coupling between the LC-circuits being substantially weak. The LC-circuits may be located, at least partly, within grooves formed in a wall of the slot waveguide. As applied to a heating apparatus employing high frequency electromagnetic wave energy or microwave energy for heating dielectric materials, the series coupled LC-circuits are arranged along a closed line which envelopes the access opening in a body of a multimode resonator heating chamber, in which the high frequency electromagnetic wave energy is employed for heating. By optimizing the parameters of the system of series coupled LC-circuits it is possible to provide rather low transmittance for a wide range of angles of incidence of waves, as well as to minimize the transmittance dependence on the angles of incidence of these waves. The later enables to achieve high protection against leaks of electromagnetic energy from the resonator heating chamber of a heating apparatus, for example, of a domestic microwave oven.

30 Claims, 3 Drawing Sheets

1. l = 2; d = 0.5; M/L = 0.0032
2. l = 4; d = 0.5; M/L = 0.0008
3. l = 8; d = 0.5; M/L = 0.0004
4. l = 16; d = 0.5; M/L = 0.00005

MULTIMODE ELECTROMAGNETIC WAVE ENERGY REJECTION FILTER ARRANGEMENT FOR A SLOT WAVEGUIDE

BACKGROUND OF THE INVENTION

1. Field of the Invention

The present invention relates generally to an apparatus which employs a high frequency electromagnetic wave energy, and more particularly to a multimode electromagnetic wave energy rejection filter arrangement for preventing leakage of electromagnetic energy from such apparatus.

2. Background of the Invention

Various techniques utilize high frequency bands in the communication field. It is well known to those skilled in the art that the demand for electromagnetic compatibility of equipment and, hence, low levels of apparatus interference is extremely important due to the active electromagnetic environment of communication systems. For that reason the problem of handling electromagnetic energy leaks has attracted considerable attention in the past years.

Nowadays, this problem has acquired a particular interest in terms of personal safety, once microwave devices have found extensive application in areas beyond scientific research and communication systems, such as food processing industry, medicine, household appliances, devices for heating of dielectric materials as, for example, domestic microwave ovens. The most advanced solutions to the problem of preventing electromagnetic leaks have been offered, naturally, in the latter application.

The arrangement for prevention of leakage of high frequency electromagnetic waves will be described herein by taking, as an example, a domestic microwave oven which utilizes high frequency electromagnetic energy for cooking or heating food items.

Generally, a microwave oven includes a magnetron for generating microwave and a resonator in which the microwave energy is employed for heating, the resonator having a body with an access opening and a door member installed so as to allow opening and closing of the access opening, the door member periphery enveloping the access opening. In the available microwave oven designs there is always a gap between the body of the resonator and the door member periphery when the access opening is closed. This gap acts a slot waveguide through which the electromagnetic energy leaks from the resonator.

Traditionally the problem of preventing this leakage is solved by using absorbing materials or installing a rejection filter either along the perimeter of the door member or along the perimeter of the access opening.

The rejection filter is commonly designed as a quarter-wave distributed-parameters choke placed along the perimeter of the door member so that it is coupled with the slot waveguide cavity via a coupling hole. An example of a rejection filter of this type is disclosed in a U.S. Pat. No. 4,584,447, wherein the filter proves quite effective in preventing leakage of high-frequency energy from the microwave oven resonator at the fundamental frequency, but it is insensitive to leakage at higher harmonics. Besides, this filter can provide effective rejection of waves only within a limited range of their angles of incidence.

All efforts towards upgrading the rejection filter design so far have pursued better characteristics and compactness of the device at a lower cost. One example is a multimode rejection filter for a microwave oven described in the European Pat. No. 0,196,214. The filter contains two quarter-wave distributed-parameters chokes, one bing tuned to the fundamental frequency of the cavity, the other being tuned to the frequency of a higher (for example, 5th) harmonic.

However, this design fails to provide an appreciably wider range of angles of incidence of the waves, wherein the filter will be effective, due to a strong coupling between the elements of the choke (i.e. a high value of mutual inductance).

The multimode rejection filter for a microwave oven according to the U.S. Pat. No. 5,075,525, comprises two quarter-wave distributed-parameters chokes, one of which being tuned to the fundamental frequency of the resonator, the other being tuned to a higher harmonic frequency, and two capacitance filters, The advantage of this arrangement is a slightly expanded range of propagation directions of the waves that are being rejected. Its major shortcoming, though, is the design complexity, a rather large size of the choke, and a nonuniform dependence of the reflectivity of waves to be rejected on their propagation directions.

The microwave oven according to the U.S. Pat. No. 4,700,034, incorporates a multimode rejection filter which is coupled with the slot waveguide cavity through a coupling hole and is essentially a series LC-circuit consisting of distributed-parameters elements. The circuit is placed inside a quarter-wave choke along a line enveloping the access opening. This filter provides good rejection of waves at the fundamental—and the 2nd—harmonic frequencies but only within a limited range of directions of propagating waves, which is the major drawback in this design. Besides, it is quite complicated structurally, which makes the overall design of microwave oven more sophisticated.

The closest analog of the present multimode rejection filter for a slot waveguide in terms of collective relevant properties featured in both designs is the multimode rejection filter proposed in the paper: "High response door seal for microwave oven" by S. Ohkava, H. Watanabe, K. Kane (Microwave Power Symposium Digest, 1978). This filter is intended for utilization in domestic microwave ovens to prevent leaks of high-frequency energy from a resonator heating chamber.

The filter comprises a system of strongly coupled series LC-circuits arranged inside a quarter-wave choke along a predetermined line intersecting the wave vectors of the waves to be rejected. It also comprises a parallel LC-circuit located inside another quarter-wave choke. Both of these quarter-wave chokes are coupled with a slot waveguide cavity via a coupling hole, the slot waveguide being formed by a body of the resonator heating chamber and a door member periphery enveloping an access opening in the heating chamber. The LC-circuits consist of distributed elements.

The disadvantages of this multimode rejection filter are the design complexity and the dependence, although a weaker one as against other filter designs used for the same purpose, of the transmittance on the propagation direction of waves to be rejected. This limits the range of angles of incidence of the waves rejected by the filter.

SUMMARY OF THE INVENTION

According to one aspect of the invention, there is provided a multimode electromagnetic wave energy rejection filter arrangement for a slot waveguide, comprising a slot waveguide, and at least one system of series coupled LC-circuits located, at least partly, within a cavity of the slot waveguide and arranged along a predetermined line intersecting the wave vectors of electromagnetic waves to be rejected, the LC-circuits including lumped elements and the coupling between the LC-circuits being substantially weak.

Preferably, the LC-circuits are located, at least partly, within a cavity of the slot waveguide.

According to another aspect of the invention, there is provided a heating apparatus employing high frequency electromagnetic wave energy for heating dielectric materials comprising a multimode resonator heating chamber in which the high frequency electromagnetic wave energy is employed for heating, having a body, the body having an access opening thereto, a door member installed so as to allow opening and closing of the access opening, the door member periphery enveloping the access opening and forming a slot waveguide with the body of the resonator when the door member is closed, and a multimode rejection filter located at least partly within a cavity of the slot waveguide, the multimode rejection filter comprising at least one system of series coupled LC-circuits, the LC-circuits including lumped elements and the coupling between the LC-circuits being substantially weak.

Desirably, the multimode rejection filter is arranged along a closed line enveloping the access opening.

The body of the resonator or the door member may act as one of the plates of a capacitor within at least one LC-circuit.

The LC-circuits may be located, at least partly, within grooves formed in the body of the resonator or in the door member.

According to a further aspect of the invention, there is provided a heating apparatus employing microwave energy for heating comprising a microwave multimode resonator heating chamber in which the microwave energy is employed for heating, having a body, the doby having an access opening thereto, a door member installed so as to allow opening and closing of the access opening, the door member periphery enveloping the access opening and forming a slot waveguide with the body of the heating chamber when the door member is closed, and a multimode rejection filter located at least partly within a cavity of the slot waveguide, the multimode rejection filter comprising at least one system of series coupled LC-circuits, the LC-circuits including lumped elements and the coupling between the LC-circuits being substantially weak.

Desirably, the multimode rejection filter is arranged along a closed line enveloping the access opening.

Preferably, the number K of LC-circuits in a system is defined by the following expression:

$$K \geq BM/d\ LT,$$

where B is the length of the multimode rejection filter arrangement; M is the mutual inductance of the LC-circuits; d is the effective cross-sectional size of an LC-circuit; L is the LC-circuit inductance; T is the predetermined transmission coefficient of the electromagnetic wave to be rejected.

The body of the resonator of the door member may act as one of the plates of a capacitor within at least one LC-circuit.

The LC-circuits may be located, at least partly, within grooves formed in the body of the resonator or in the door member.

In one embodiment the LC-circuits within at least one system of coupled circuits are tuned to the frequency of the wave to be rejected.

In another embodiment the LC-circuits within at least one system of coupled circuits are tuned to different frequencies which are substantially close to the frequency of the wave to be rejected.

In a still further embodiment the multimode rejection filter further comprises at least a second system of substantially weakly coupled series LC-circuits, the LC-circuits within different systems of coupled circuits being tuned to different frequencies corresponding to the frequencies of waves to be rejected.

According to a still further aspect of the invention, there is provided a multimode electromagnetic wave energy rejection filter arrangement comprising a multimode resonator heating chamber in which the high frequency electromagnetic wave energy is employed for heating, having a body, the body having an access opening thereto, a door member installed so as to allow opening and closing of the access opening, the door member periphery enveloping the access opening and forming a slot waveguide with the body of the heating chamber when the door member is closed, wherein the body of the heating chamber and the door member periphery act as corresponding walls of the slot waveguide, and at least one system of series coupled LC-circuits contained at least partly within a cavity of the slot waveguide, the LC-circuits including lumped elements, the coupling between the LC-circuits being substantially weak.

Desirably, the LC-circuits are arranged along a closed line enveloping the access opening.

Preferably, the LC-circuits are located, at least partly, within grooves formed in a wall of the slot waveguide.

Conveniently, one of the walls of the slot waveguide may act as one of the plates of a capacitor within at least one LC-circuit.

In one embodiment the LC-circuits within at least one system of coupled circuits are tuned to the frequency of the wave to be rejected.

In another embodiment the LC-circuits within at least one systems of coupled circuits are tuned to different frequencies which are substantially close to the frequency of the wave to be rejected.

In a still further embodiment the multimode electromagnetic wave energy rejection filter arrangement further comprises at least a second system of substantially weakly coupled series LC-circuits, the LC-circuits within different systems of coupled circuits being tuned to different frequencies corresponding to the frequencies of waves to be rejected.

Desirably, the number K of LC-circuits in a system is defined by the following expression:

$$K \geq BM/d\ LT,$$

where B is the length of the multimode rejection filter arrangement; M is the mutual inductance of the LC-circuits; d is the effective cross-sectional size of the LC-circuit; L is the LC-circuit inductance; T is the predetermined transmission coefficient of an electromagnetic wave to be rejected.

BRIEF DESCRIPTION OF THE DRAWINGS

The present invention will become more fully understood from the detail description given hereinbelow and the accompanying drawings which are given by way of illustration only, and thus are not limitative of the present invention. It is to be understood that other embodiments may be utilized and structural changes may be made without departing from the scope of the present invention.

DETAILED DESCRIPTION OF THE PREFERRED EMBODIMENTS

The multimode rejection filter arrangement according to the present invention can be utilized in communication systems and various high frequency apparatus. In the description herein the basic principle of the invention will be illustrated by an embodiment where the multimode electromagnetic wave energy rejection filter arrangement is used in a device for heating of dielectric materials, the later being accomplished as a domestic microwave oven, and will be described in detail with reference to the accompanying drawings. The device for heating of dielectric materials may also be accomplished as an apparatus for continuous technological processes involving a conveyer line for load/unload operations and other application.

Figure 1:
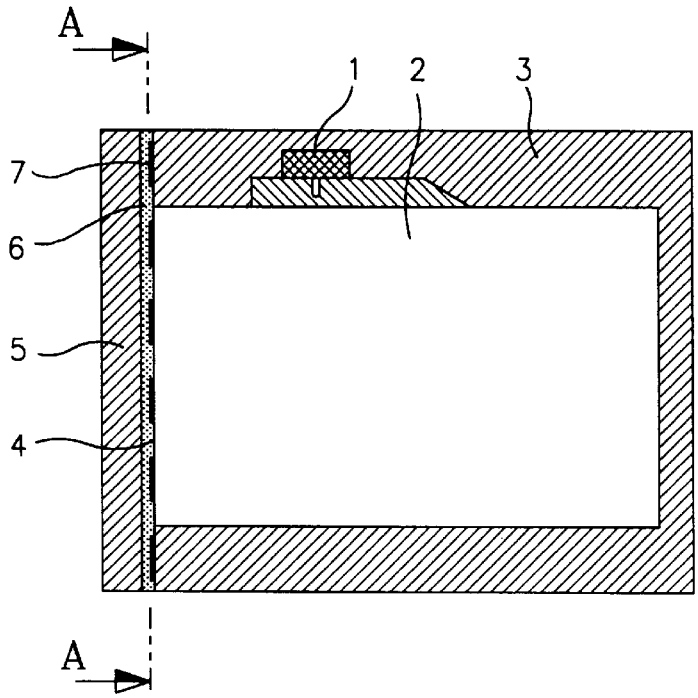
FIG. 1 is a cross-sectional view showing a domestic microwave oven using a multimode electromagnetic wave energy rejection filter arrangement for a slot waveguide according to an embodiment of the present invention.

As shown in FIG. 1 the microwave oven employing microwave energy for heating according to the present invention includes a magnetron 1 to serve as a microwave source and a microwave multimode resonator heating chamber 2, in which the microwave energy is employed for heating. The microwave multimode resonator heating chamber 2 has a body 3 with an access opening 4 and a door member 5 installed so as to allow opening and closing of the access opening 4. The door member 5 periphery envelops the access opening 4 and forms 2 when the door member 5 is closed. A multimode rejection filter 7 is installed in a general case, at least partly, in a cavity of the slot waveguide 6.

Figure 2:
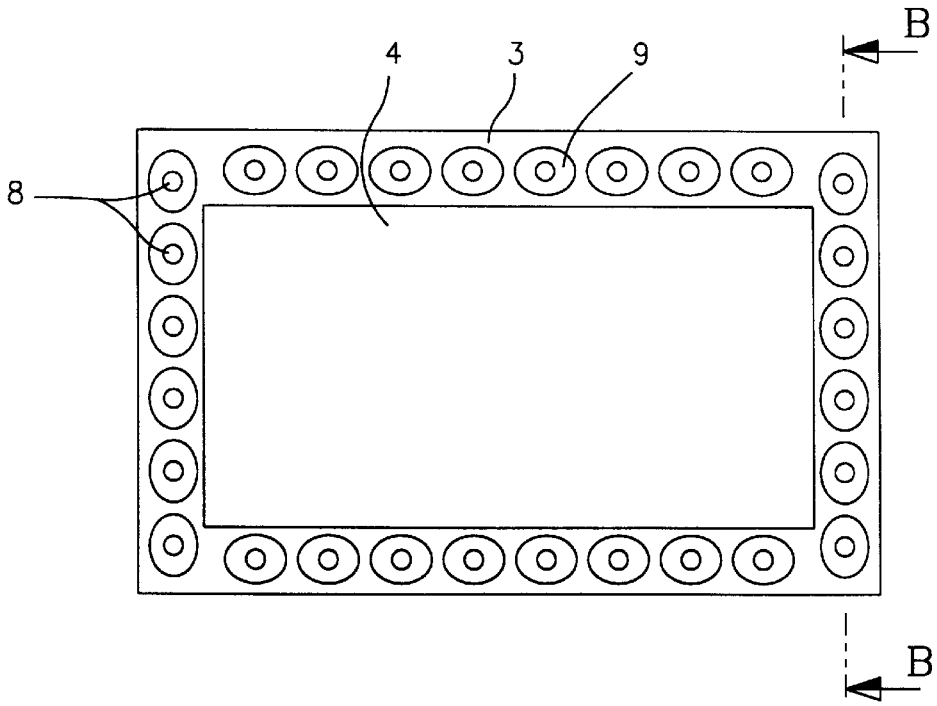
FIG. 2 is a cross-sectional view illustrating an arrangement of LC-circuits taken along the line A—A within a multimode electromagnetic wave energy rejection filter in FIG. 1.

As shown in FIG. 2, the multimode rejection filter 7 is arranged along a closed line enveloping the access opening 4 and in a general case, includes at least one system of substantially weakly coupled series LC-circuits 8. The LC-circuits 8 include lumped elements and are partly located in grooves 9.

When the access opening 4 is closed by the door member 5, the magnetron 1 distributes microwave energy into the microwave multimode resonator heating chamber 2 and forms a complicated field structure in it. Plane waves fall at arbitrary angles ranging from 0 to $\pi/2$ upon the slot waveguide 6 formed by the periphery of the door member 5 and the body 3 of heating chamber 2. The plane waves excite corresponding modes in the slot waveguide 6, which propagate through the waveguide 7 to the multimode rejection filter 7. Since the LC-circuits 8 within at least one system of coupled circuits within the multimode rejection filter 7 are tuned to the frequency of the wave to be rejected or are tuned to different frequencies which are substantially close to the frequency of the wave to be rejected, (or in the embodiment, where the multimode rejection filter further comprises at least a second system of substantially weakly coupled series LC-circuits, the LC-circuits within different systems of coupled circuits are tuned to different frequencies corresponding to the frequencies of waves to be rejected), while the series LC-circuits include lumped elements and are substantially weakly coupled, the multimode rejection filter 7 provides rejection of the plane waves incident upon it.

The power transmittance for oblique incident waves on the system of resonance LC-circuits 8 located in the cross-section of the slot waveguide 6 is defined by the following equation:

$$T^2=[(B/Kd)*(M/L)]^2*\{1-\mathrm{Cos}\,[(kB/K)\ \mathrm{Sin}\ \theta]\}^2, \quad (1)$$

where $T^2$ is the power transmission coefficient; B is the length of the multimode rejection filter 7; K is the number of LC-circuits 8 in the system; d is the effective cross-sectional size of the LC-circuit 8; M is the mutual inductance of the LC-circuits 8; L is the inductance of the LC-circuit 8; $k=2\ (\pi/\lambda i)$; $\lambda i$ is the length of the wave to be rejected; and $\theta$ is the incident angle of plane waves incident upon the multimode rejection filter 7.

As follows from the above equation, the power transmittance can be decreased by reducing the mutual inductance M (i.e., the coupling between the LC-circuits) and by increasing the inductance L of the resonance LC-circuits 8 and their number K.

Thus, by optimizing the parameters of the multimode rejection filter 7 it is possible to provide rather low transmittance for a wide range of the angles of incidence of waves, as well as to minimize the transmittance ependence on the angles of incidence of these waves.

Figure 6:
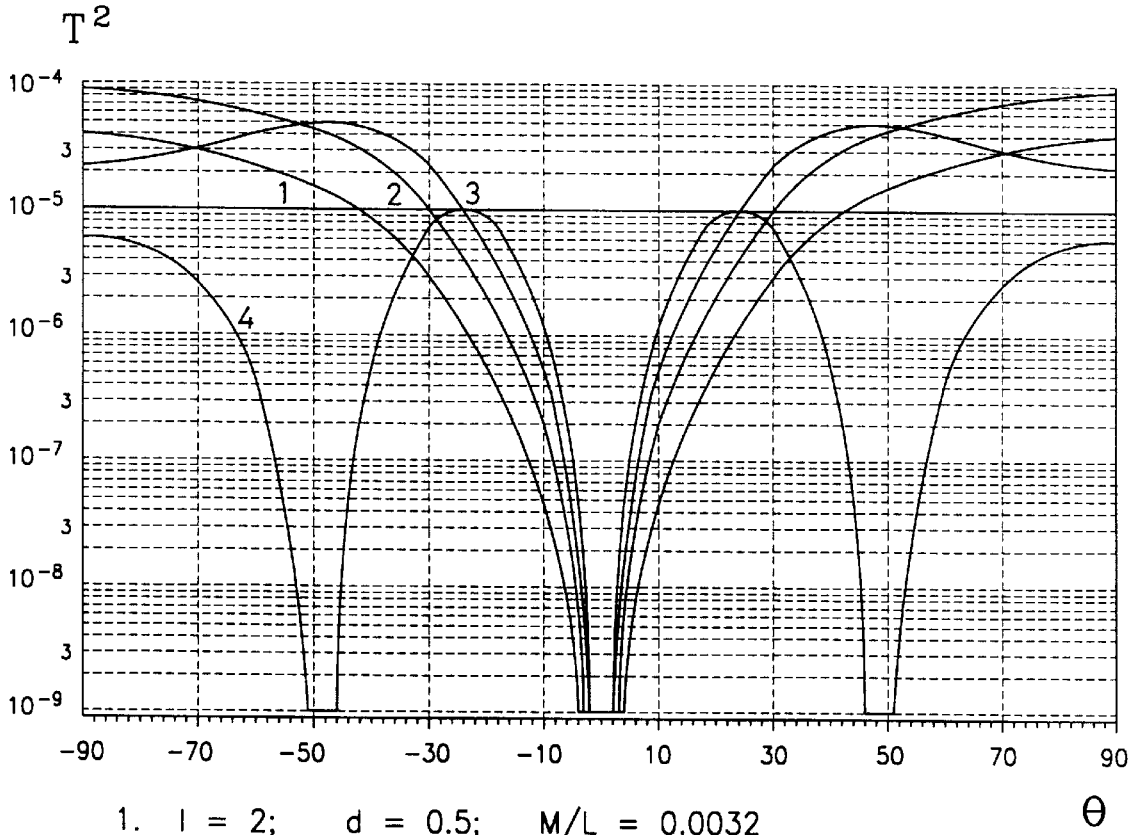
FIG. 6 is a logarithmic graph showing the plotted dependencies of the power transmittance coefficient with respect to incident angles of the microwaves.

This extends the range of the angles of incidence of waves to be effectively rejected by the filter, which is illustrated by the plotted dependencies of the power transmittance on the angle of wave incidence for different values of parameter 1 (1=B/K), provided in FIG. 6.

As seen from FIG. 6, the values of transmittance for the predetermined parameters of the filter do not exceed 0.0001 and can be decreased further to 0.00001. Besides, it is well seen that the angle of incidence dependence is weak and does not exceed 0.0001 over the entire range of angles from −90 degrees to 90 degrees.

Figure 3:
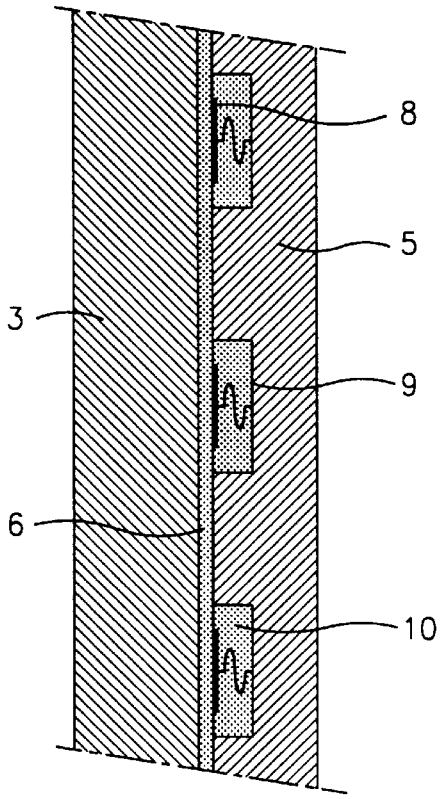
FIG. 3 is a cross-sectional view showing an arrangement of LC-circuits taken along the line B—B within a multimode electromagnetic wave energy rejection filter in FIG. 2 according to an embodiment where LC-circuits are located partly within grooves formed in the door member, wherein the body of the resonator heating chamber acts as a capacitor plate within the LC-circuits.

In the embodiment shown in FIG. 3, the same as in the embodiments shown in FIGS. 1 and 2, the LC-circuits 8 are also partly located in grooves 9 made in the door member 5, however the grooves 9 here are filled with a dielectric 10 the same as the waveguide 6. In this embodiment one of the walls of the slot waveguide 6, specifically, the body 3 of the heating chamber 2 acts as a plate of the capacitor within LC-circuits 8.

Figure 4:
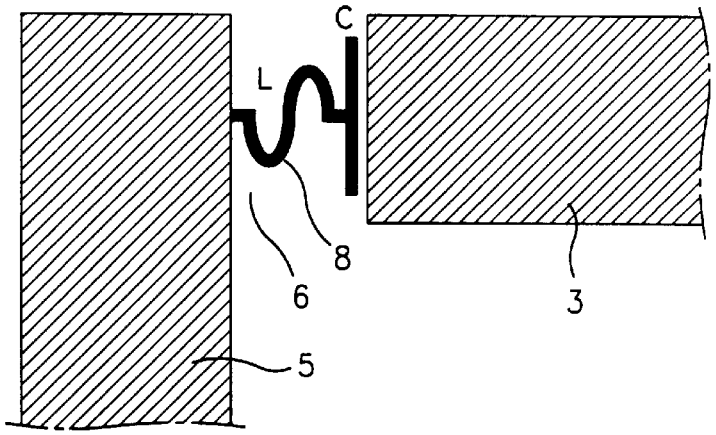
FIG. 4 is a cross-sectional view showing an arrangement of one of the LC-circuits according to an embodiment of the present invention where the LC-circuit is entirely located in a slot waveguide, wherein the body of the resonator heating chamber acts as the capacitor plate of the LC-circuit.

In a particular embodiment of the multimode rejection filter 7 shown in FIG. 4 the LC-circuit 8 is entirely located within the slot waveguide 6, while the body 3 acts as a plate of the capacitor within the LC-circuit 8.

Figure 5:
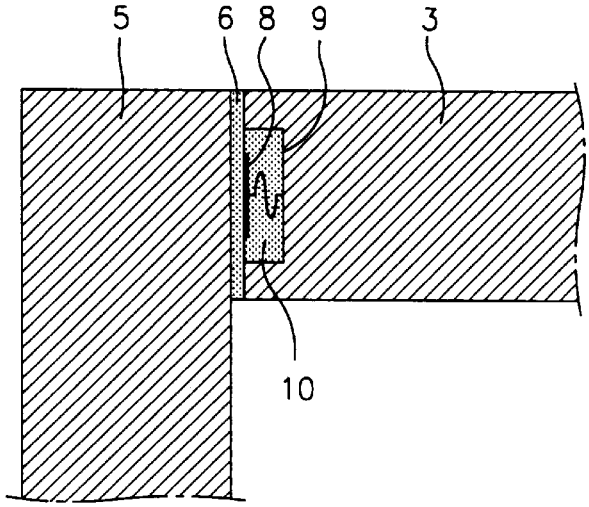
FIG. 5 is a cross-sectional view showing an arrangement of one of the LC-circuits according to an embodiment of the present invention where the LC-circuit is entirely located in the slot waveguide, wherein the body of the resonator heating chamber acts as the capacitor plate of the LC-circuit.

In an embodiment of the multimode electromagnetic wave energy rejection filter 7 shown in FIG. 5 the door member 5 acts as a plate of the capacitor within the LC-circuit 8. In this embodiment the LC-circuit 8 is partly located within the waveguide 6, and partly in a special groove 9 made in the body 3 of the heating chamber 2, the waveguide 6 and the groove 9 being filled with the dielectric 10.

The dielectric 10, for example, can be polyethylene or teflon.

By using one of the walls of the slot waveguide 6 or, as applied to a heating apparatus employing high frequency electromagnetic wave energy for heating dielectric materials or to a microwave oven employing microwave energy for heating, the body 3 of the multimode resonator chamber 2 or the door member 5 to form one of the capacitor plates of at least one LC-circuit 8, it is possible to reduce the overall dimensions of the multimode rejection filter and, hence, the overall size of the heating apparatus.

By tuning the LC-circuits 8 of at least one system of coupled circuits to different frequencies which are substantially close to the frequency of the wave to be rejected it is possible to broaden the frequency band and to reduce the exploitation requirements on the filter.

Moreover, tuning of the LC-circuits 8 of different systems of coupled circuits to different frequencies corresponding to those of waves to be rejected, in particular, to frequencies corresponding to harmonics of the operating frequency of magnetron 1, provides further rejection of waves at these frequencies.

The described capabilities provide the effect pursued by the present invention, which was to develop an upgraded performance multimode electromagnetic wave energy rejection filter for a slot waveguide, using simple and inexpensive design solutions, which, when utilized in a device for heating of dielectric materials, for example, a domestic microwave oven, can provide higher protection against leaks of electromagnetic energy from the resonator heating chamber.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A multimode electromagnetic wave energy rejection filter arrangement for a slot waveguide comprising:

a slot waveguide; and at least one system of series-resonant coupled LC-circuits located, at least partly, within a cavity of the slot waveguide and arranged along a predetermined line intersecting the wave vectors of electromagnetic waves to be rejected;

the LC-circuits including lumped elements and the coupling between the LC-circuits being weak.

2. A multimode electromagnetic wave energy rejection filter arrangement of claim 1, wherein the LC-circuits are located, at least partly, within grooves formed in a wall of the slot waveguide.

3. A heating apparatus employing high frequency electromagnetic wave energy for heating dielectric materials comprising:

a multimode resonator heating chamber in which the high frequency electromagnetic wave energy is employed for heating, having a body, the body having an access opening thereto;

a door member installed so as to allow opening and closing of the access opening, the door member periphery enveloping the access opening and forming a slot waveguide with the body of the resonator when the door member is closed; and a multimode rejection filter located at least partly within a cavity of the slot waveguide;

the multimode rejection filter comprising at least one system of series-resonant coupled LC-circuits, the LC-circuits including lumped elements and the coupling between the LC-circuits being weak.

4. A heating apparatus of claim 3, wherein the multimode rejection filter is arranged along a closed line enveloping the access opening.

5. A heating apparatus of claim 3, wherein the body of the resonator acts as one of the plates of a capacitor within at least one LC-circuit.

6. A heating apparatus of claim 3, wherein the door member acts as one of the plates of a capacitor within at least one LC-circuit.

7. A heating apparatus of claim 3, wherein the LC-circuits are located, at least partly, within grooves formed in the body of the resonator.

8. A heating apparatus of claim 3, wherein the LC-circuits are located, at least partly, within grooves formed in the door member.

9. A heating apparatus employing microwave energy for heating comprising:

a microwave multimode resonator heating chamber in which the microwave energy is employed for heating, having a body, the body having in access opening thereto;

a door member installed so as to allow opening and closing of the access opening, the door member periphery enveloping the access opening and forming a slot waveguide with the body of the heating chamber when the door member is closed; and a multimode rejection filter located at least partly within a cavity of the slot waveguide;

the multimode rejection filter comprising at least one system of series-resonant coupled LC-circuits, the LC-circuits including lumped elements and the coupling between the LC-circuits being weak.

10. A heating apparatus of claim 9, wherein the multimode rejection filter is arranged along a closed line enveloping the access opening.

11. A heating apparatus of claim 9, wherein the number K of LC-circuit in a system is defined by the following expression:

$$K \geq BM/d\ LT,$$

where B is the length of the multimode rejection filter arrangement; M is the mutual inductance of the LC-circuits; d is the effective cross-sectional size of an LC-circuit; L is the LC-circuit inductance; T is the predetermined transmission coefficient of the electromagnetic wave to be rejected.

12. A heating apparatus of claim 9, wherein the body of the heating chamber acts as one of the plates of a capacitor within at least one LC-circuit.

13. A heating apparatus of claim 12, wherein the LC-circuits are located, at least partly, within grooves formed in the body of the heating chamber.

14. A heating apparatus of claim 12, wherein the LC-circuits are located, at least partly, within grooves formed in the door member.

15. A heating apparatus of claim 9, wherein the door member acts as one of the plates of a capacitor within at least one LC-circuit.

16. A heating apparatus of claim 15, wherein the LC-circuits are located, at least partly, within grooves formed in the body of the heating chamber.

17. A heating apparatus of claim 15, wherein the LC-circuits are located, at least partly, within grooves formed in the door member.

18. A heating apparatus of claim 9, wherein the LC-circuits are located, at least partly, within grooves formed in the body of the heating chamber.

19. A heating apparatus of claim 9, wherein the LC-circuits are located, at least partly, within grooves formed in the door member.

20. A heating apparatus of claim 9, wherein the LC-circuits within at least one system of coupled circuits are tuned to the frequency of a wave to be rejected.

21. A heating apparatus of claim 9, wherein the LC-circuits within at least one system of coupled circuits are tuned to different frequencies which are substantially close to the frequency of the wave to be rejected.

22. A heating apparatus of claim 9, wherein the multimode rejection filter further comprises at least a second system of slightly coupled series-resonant LC-circuits, the LC-circuits within the different systems being tuned to different frequencies corresponding to the frequencies of waves to be rejected.

23. A multimode electromagnetic wave energy rejection filter arrangement comprising:

a multimode resonator heating chamber in which the high frequency electromagnetic wave energy is employed for heating, having a body, the body having an access opening thereto;

a door member installed so as to allow opening and closing of the access opening, the door member periphery enveloping the access opening and forming a slot waveguide with the body of the heating chamber when the door member is closed, wherein the body of the heating chamber and the door member periphery act as corresponding walls of the slot waveguide; and at least one systems of series-resonant LC-circuits contained at least partly within a cavity of the slot waveguide;

the LC-circuits including lumped elements and the coupling between the LC-circuits being weak.

24. A multimode electromagnetic wave energy rejection filter arrangement of claim 23, wherein the LC-circuits are arranged along a closed line enveloping the access opening.

25. A multimode electromagnetic wave energy rejection filter arrangement of claim 23, wherein the LC-circuits are located, at least partly, within grooves formed in a wall of the slot waveguide.

26. A multimode electromagnetic wave energy rejection filter arrangement of claim 23, wherein one of the walls of the slot waveguide acts as one of the plates of a capacitor within at least one LC-circuit.

27. A multimode electromagnetic wave energy rejection filter arrangement of claim 23, wherein the LC-circuits within at least one system of coupled circuits are tuned to the frequency of a wave to be rejected.

28. A multimode electromagnetic wave energy rejection filter arrangement of claim 23, wherein the LC-circuits within at least one system of coupled circuits are tuned to different frequencies which are substantially close to the frequency of the wave to be rejected.

29. A multimode electromagnetic wave energy rejection filter arrangement of claim 23 further comprising at least a second system of weakly coupled series-resonant LC-circuits contained at least partly within the cavity of the slot waveguide and arranged along a closed line enveloping the access opening, the LC-circuits within the different systems being tuned to different frequencies corresponding to the frequencies of waves to be rejected.

30. A multimode electromagnetic wave energy rejection filter arrangement of claim 23, wherein the number K of LC-circuits in a system is defined by the following expression:

$$K \geq BM/d\,LT,$$

wherein B is the length of the multimode rejection filter arrangement; M is the mutual inductance of the LC-circuits; d is the effective cross-sectional size of an LC-circuit; L is the LC-circuit inductance; T is the predetermined transmission coefficient of an electromagnetic wave to be rejected.

* * * * *